United States Patent [19]

Cheung

[11] Patent Number: 4,604,117

[45] Date of Patent: Aug. 5, 1986

[54] HYBRID NITROGEN GENERATOR WITH AUXILIARY COLUMN DRIVE

[75] Inventor: Harry Cheung, Kenmore, N.Y.

[73] Assignee: Union Carbide Corporation, Danbury, Conn.

[21] Appl. No.: 671,940

[22] Filed: Nov. 15, 1984

[51] Int. Cl.[4] ..... F25J 3/02

[52] U.S. Cl. ..... 62/25; 62/28; 62/29; 62/31; 62/34; 62/38

[58] Field of Search ..... 62/38, 39, 24, 25, 27, 62/28, 29, 31, 34

[56] References Cited

U.S. PATENT DOCUMENTS 4,254,629 3/1981 Olszewski ..... 62/38

*Primary Examiner*—Frank Sever

*Attorney, Agent, or Firm*—Stanley Ktorides

[57] ABSTRACT

A cryogenic rectification process to produce nitrogen at relatively high purity and yield employing multiple defined feeds to a main rectification column to allow for increased product removal off the top of the main column.

15 Claims, 4 Drawing Figures

HYBRID NITROGEN GENERATOR WITH AUXILIARY COLUMN DRIVE

TECHNICAL FIELD

This invention relates generally to the field of cryogenic distillative air separation and more particularly is an improvement whereby nitrogen may be produced at reatively high purity and at high recovery.

BACKGROUND OF THE INVENTION

Nitrogen at relatively high purities is finding increasing usage in such applications as for blanketing, stirring or inerting purposes in such industries as glass and aluminum production, and in enhanced oil or natural gas recovery. Such applications consume large quantities of nitrogen and thus there is a need to produce relatively high purity nitrogen at high recovery and at relatively low cost.

Capital costs are kept low by avoiding the need to employ a full scale double column air separation process. Operating costs are reduced by energy efficient operation. Since a large part of the power required by the air separation process is consumed by the feed air compressor, it is desirable to recover as product as much of the feed air as is practical.

It is therefore an object of this invention to provide an improved air separation process for the cryogenic distillative separation of air.

It is another object of this invention to provide an improved air separation process for the cryogenic separation of air which can produce nitrogen at relatively high purity and relatively high yield.

It is a further object of this invention to provide an improved air separation process for the cryogenic separation of air which can produce nitrogen at relatively high purity and relatively high yield while avoiding the need to employ a full scale double column.

SUMMARY OF THE INVENTION

The above and other objects which will become apparent to one skilled in the art upon a reading of this disclosure are attained by this invention which comprises:

A process for the production of nitrogen at relatively high yield and purity by cryogenic rectification of feed air comprising:

(1) introducing the major portion of the feed air into a main rectification column which is operating at a pressure in the range of from 35 to 145 psia, and wherein feed is separated into nitrogen-rich vapor and oxygen-enriched liquid;

(2) introducing a minor portion of the feed air into a prefractionation zone at a pressure greater than that at which the main column is operating, and wherein the minor portion is separated into a nitrogen-enriched vapor fraction and an oxygen-enriched liquid fraction;

(3) condensing at least some of the nitrogen-enriched vapor fraction by indirect heat exchange with the oxygen-enriched liquid produced in the main column;

(4) introducing at least some of the resulting condensed nitrogen-enriched fraction, as reflux liquid and additional feed, into the main column at a point at least one tray above the point where the major portion of the feed air is introduced into the main column;

(5) condensing a first portion of the nitrogen-rich vapor by indirect heat exchange with vaporizing oxygen-enriched liquid;

(6) passing at least some of the resulting condensed nitrogen-rich first portion to the main column at a point at least one tray above the point where the condensed nitrogen-enriched fraction is introduced into the main column; and (7) recovering a second portion of the nitrogen-rich vapor as product nitrogen.

The term, "column", as used in the present specification and claims means a distillation or fractionation column or zone, i.e., a contacting column or zone wherein liquid and vapor phases are countercurrently contacted to effect separation of a fluid mixture, as for example, by contacting of the vapor and liquid phases on a series or vertically spaced trays or plates mounted within the column or alternatively, on packing elements with which the column is filled. For a further discussion of distillation columns see the *Chemical Engineers' Handbook*, Fifth Edition, edited by R. H. Perry and C. H. Chilton, McGraw-Hill Book Company, New York, Section 13, "Distillation" B. D. Smith et al, page 1303, *The Continuous Distillation Process*. The term, double column is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation. Vapor and liquid contacting separation processes depend on the difference in vapor pressures for the components. The high vapor pressure (or more volatile or low boiling) component will tend to concentrate in the vapor phase whereas the low vapor pressure (or less volatile or high boiling) component will tend to concentrate in the liquid phase. Distillation is the separation process whereby heating of a liquid mixture can be used to concentrate the volatile component(s) in the vapor phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns.

The term "indirect heat exchange", as used in the present specification and claims, means the bringing of two fluid streams into heat exchange relation without any physical contact or intermixing of the fluids with each other.

As used herein, the term "tray" means a contacting stage, which is not necessarily an equilibrium stage, and may mean other contacting apparatus such as packing having a separation capability equivalent to one tray.

As used herein, the term "equilibrium stage" means a vapor-liquid contacting stage whereby the vapor and liquid leaving the stage are in mass transfer equilibrium, e.g. a tray having 100 percent efficiency or a packing element equivalent to one height equivalent of a theoretical plate (HETP).

As used herein, the term "prefractionation zone" means a region in which mass transfer occurs and results in the production of nitrogen-richer and oxygen-rich fractions when air is fed to the prefractionation zone.

DETAILED DESCRIPTION

The process of this invention will be described in detail with reference to the drawings.

Figure 1:
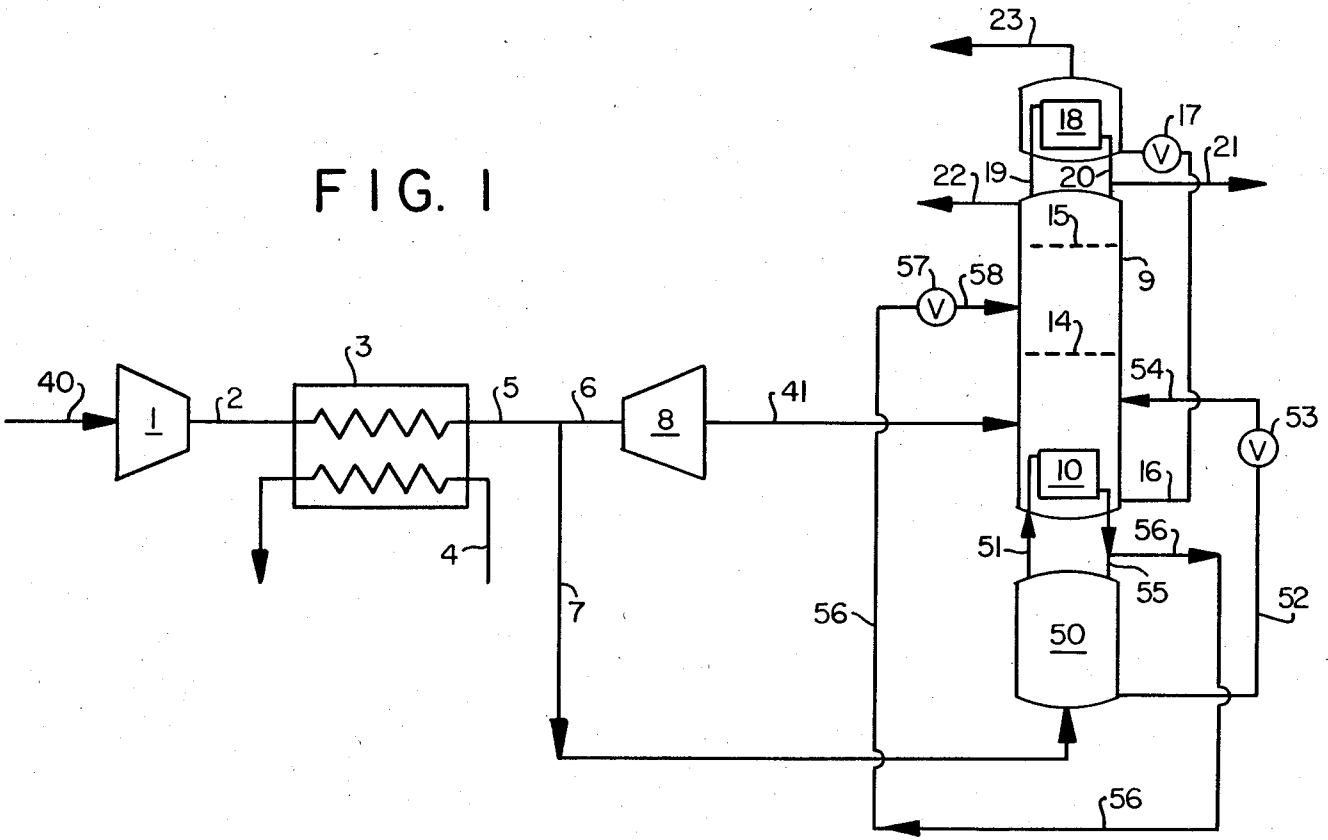
FIG. 1 is a schematic representation of one preferred embodiment of the process of this invention.

Referring now to FIG. 1, feed air 40 is compressed in compressor 1 and the compressed feed air stream 2 is cooled in heat exchanger 3 by indirect heat exchange with stream or streams 4 which may conveniently be return stream(s) from the air separation process. Impurities such as water and carbon dioxide may be removed by any conventional method such as reversing heat exchange or adsorption.

The compressed and cooled feed air 5 is divided into major portion 6 and minor portion 7. Major portion 6 may comprise from about 60 to 95 percent of the total feed air and preferably comprises from about 70 to 90 percent of the feed air. Minor portion 7 may comprise from about 5 to 40 percent of the total feed air and preferably comprises from about 10 to 30 percent of the feed air.

Major portion 6 is expanded through turboexpander 8 to produce refrigeration for the process and expanded stream 41 is introduced into column 9 operating at a pressure in the range of from about 35 to 145 pounds per square inch absolute (psia), preferably from about 40 to 100 psia. Below the lower pressure range limit the requisite heat exchange will not work effectively and above the upper pressure range limit minor portion 7 requires excessive pressure. Within column 9, feed air is separated by cryogenic rectification into nitrogen-rich vapor and oxygen-enriched liquid.

Minor portion 7 is passed to prefractionation zone 50 wherein it is separated into a nitrogen-enriched vapor fraction and an oxygen-enriched liquid fraction. FIG. 1 illustrates a preferred embodiment wherein prefractionation zone 50 is a small column having no more than one half the number of equilibrium stages, and preferably having no more than one quarter the number of equilibrium stages, as has main column 9. Prefractionation zone 50 may also comprise one or more condensers and phase separators.

Prefractionation zone 50 operates at a pressure which is higher than that at which main column 9 is operating. This is required in order to vaporize oxygen-enriched liquid at the bottom of the main column. Generally, the pressure of the prefractionation zone 50 will be from 10 to 90 psi, preferably from 15 to 60 psi, above that pressure at which main column 9 is operating.

In prefractionation zone 50, minor portion 7 is separated into a nitrogen-enriched vapor fraction and an oxygen-enriched liquid fraction. At least some of the nitrogen-enriched vapor fraction is passed as stream 51 to condenser 10 at the base of column 9 wherein it is condensed by indirect heat exchange with vaporizing oxygen-enriched liquid produced in main column 9. The resulting oxygen-enriched vapor flows up through main column 9 as stripping vapor. When the prefractionation zone 50 is a column, some of the resulting condensed nitrogen-enriched fraction may be passed as stream 55 to the prefractionation zone as reflux. At least some of the resulting condensed nitrogen-enriched fraction is passed as stream 56 to valve 57 through which it is expanded and introduced into main column 9 as reflux and feed. Stream 58 is introduced into main column 9 at a point at least one tray above the point where the major portion of the feed air is introduced into main column 9. In FIG. 1, tray 14 is above the point where stream 41 is introduced into main column 9 and stream 58 is shown as being introduced into main column 9 above tray 14. The liquified nitrogen-enriched fraction introduced into main column 9 as stream 58 serves as liquid reflux and undergoes separation by cryogenic rectification into nitrogen-rich vapor and oxygen-enriched liquid.

FIG. 1 illustrates a preferred embodiment wherein at least a portion of the oxygen-enriched liquid fraction produced in prefractionation zone 50 is withdrawn as stream 52, expanded through valve 53, and introduced as stream 54 into main column 9 wherein it undergoes separation by cryogenic rectification into nitrogen-rich vapor and oxygen-enriched liquid. Stream 54 is introduced into main column 9 at least one tray below the point where stream 58 is introduced. Preferably stream 54 is introduced into main column 9 slightly above the point where major air feed 41 is introduced. As will be explained more fully later, the prefractionation zone serves to increase the quality of the reflux passed to main column 9 and this results in the more efficient operation of main column 9.

It is seen that the pressure of the minor feed air portion entering prefractionation zone 50 exceeds that of the major feed air portion entering column 9. FIG. 1 illustrates a preferred way to achieve this pressure differential wherein the entire feed air stream is compressed and then the major portion is turboexpanded to provide plant refrigeration prior to introduction into column 9. Alternatively, only the minor feed air portion could be compressed to the requisite pressure exceeding the column operating pressure. In this situation, plant refrigeration may be provided by expansion of a return waste or product stream. In yet another variation, some plant refrigeration may be provided by an expanded major feed air portion and some by an expanded return stream.

As mentioned previously, the feed in main column 9 is separated into nitrogen-rich vapor and oxygen-enriched liquid. A first portion 19 of the nitrogen-rich vapor is condensed in condenser 18 by indirect heat exchange with oxygen-enriched liquid which is taken from the bottom of main column 9 as stream 16, expanded through valve 17 and introduced to the boiling side of condenser 18. The oxygen-enriched vapor which results from this heat exchange is removed as stream 23. This stream may be expanded to produce plant refrigeration, recovered in whole or in part, or simply released to the atmosphere. The condensed first nitrogen-rich portion 20 resulting from this overhead heat exchange is passed, at least in part, to main column 9 as liquid reflux at a point at least one tray above the point where the condensed nitrogen-enriched fraction 58 is introduced into main column 9. In FIG. 1, tray 15 is above the point where stream 58 is introduced into main column 9, and stream 20 is shown as being introduced into main column 9 above tray 15. If desired, a part 21 of stream 20 may be removed and recovered as high purity liquid nitrogen. If employed, part 21 is from about 1 to 10 percent of stream 20.

A second portion 22 of the nitrogen-rich vapor is removed from the column and recovered as product nitrogen. The product nitrogen has a purity of at least 98 mole percent and can have a purity up to 99.9999 mole percent or 1 ppm oxygen contaminant. The product nitrogen is recovered at high yield. Generally the product nitrogen, i.e., the nitrogen recovered in stream 22 and in stream 21 if employed, will be at least 50 percent of the nitrogen fed to the process and typically is at least 60 percent. The yield may range up to about 82 percent.

Figure 2:
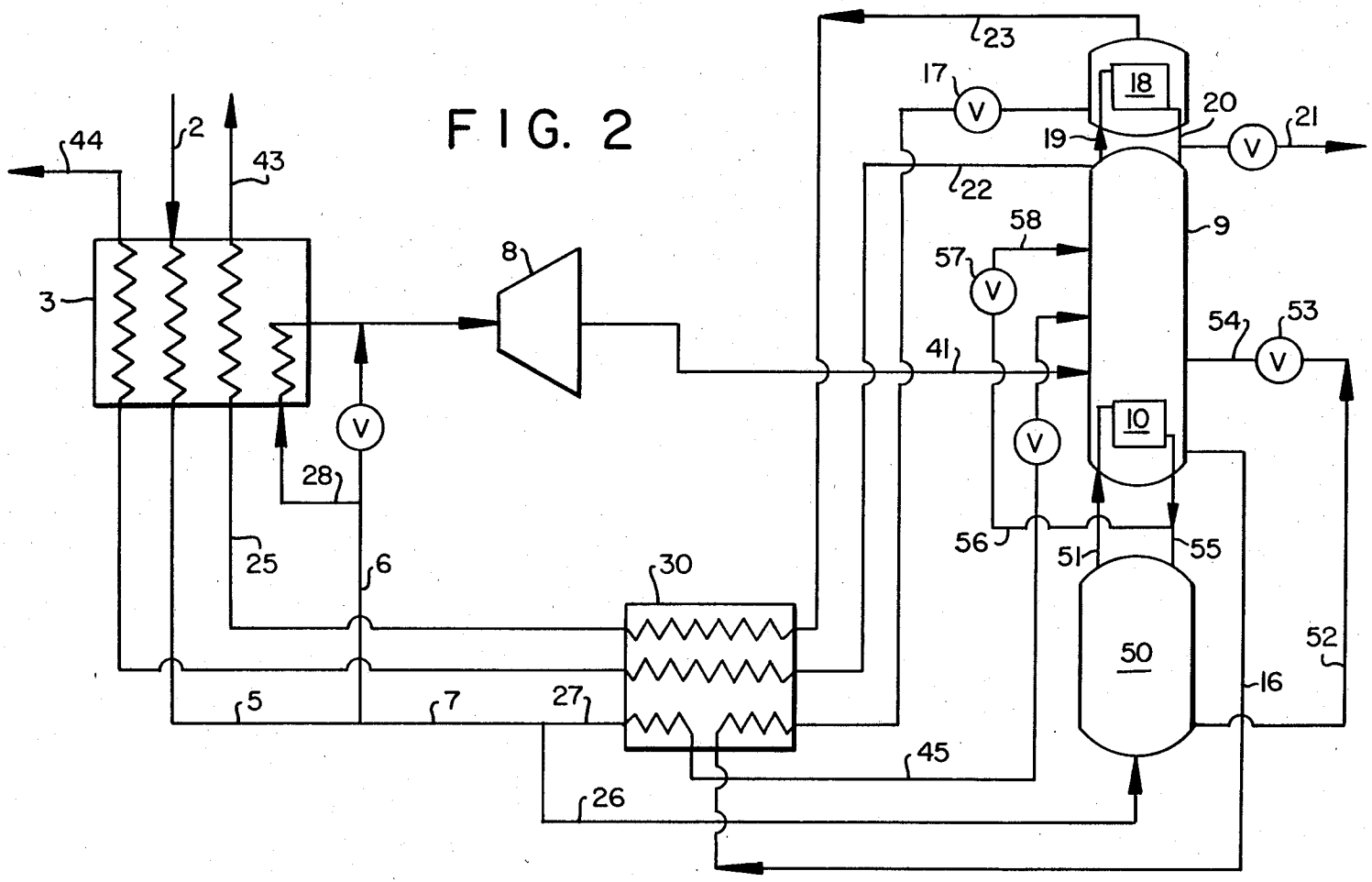
FIG. 2 is a schematic representation of another preferred embodiment of the process of this invention.

FIG. 2 illustrates a comprehensive air separation plant which employs a preferred embodiment of the process of this invention. The numerals of FIG. 2 correspond to those of FIG. 1 for the equivalent elements. Referring now to FIG. 2, compressed feed air 2 is cooled by passage through reversing heat exchanger 3 against outgoing streams. High boiling impurities in the feed stream, such as carbon dioxide and water, are deposited on the passages of reversing heat exchanger 3. As is known to those skilled in the art, the passages through which feed air passes are alternated with those of outgoing stream 25 so that the deposited impurities may be swept out of the heat exchanger. Cooled, cleaned and compressed air stream 5 is divided into major portion 6 and minor portion 7. All or most of minor stream 7 is passed as stream 26 to prefractionation zone 50. A small part 27 of minor portion 7 may bypass prefractionation zone 50 to satisfy a heat balance as will be more fully described later.

As previously described with reference to FIG. 1, minor feed stream 26 is separated in prefractionation zone 50 into a nitrogen-enriched vapor fraction and an oxygen-enriched liquid fraction. At least some of the nitrogen-enriched vapor fraction is condensed in condenser 10 by vaporizing main column bottoms and at least some of the resulting condensed nitrogen-enriched fraction is expanded through valve 57 and introduced 58 into main column 9. A portion of the oxygen-enriched liquid fraction may be withdrawn 52 from prefractionation zone 50, expanded through valve 53 and introduced into main column 9.

The major portion 6 of the feed air is passed to expansion turbine 8. A side stream 28 of portion 6 is passed partially through reversing heat exchanger 3 for heat balance and temperature profile control of this heat exchanger in a manner well known to those skilled in the art. The side stream 28 is combined with stream 6 and, after passage through expander 8, the major feed air portion is introduced into main column 9.

Oxygen-enriched liquid collecting in the base of main column 9 is withdrawn as stream 16, cooled by outgoing streams in heat exchanger 30, expanded through valve 17 and introduced to the boiling side of condenser 18 where it vaporizes against condensing nitrogen-rich vapor introduced to condenser 18 as stream 19. The resulting oxygen-enriched vapor is withdrawn as stream 23, passed through heat exchangers 30 and 3 and exits the process as stream 43. Nitrogen-rich vapor is withdrawn from main column 9 as stream 22, passed through heat exchangers 30 and 3 and recovered as stream 44 as product nitrogen. The condensed nitrogen 20 resulting from the overhead heat exchange is passed into main column 9 as reflux. A part 21 of this liquid nitrogen may be recovered.

Small air stream 27 is condensed and subcooled in heat exchanger 30. The resulting liquid air 45 is introduced into main column 9 between major air feed 41 and liquid nitrogen-enriched fraction 58. The purpose of this small liquid air stream is to satisfy the heat balance around the column and in the reversing heat exchanger. This extra refrigeration is required to be added to the column if the production of a substantial amount of liquid nitrogen product is desired. In addition the air stream 27 is used to warm the return streams in heat exchanger 30 so that no liquid air is formed in reversing heat exchanger 3. Stream 27 generally is less than 10 percent of the total feed air and those skilled in the art can readily determine the magnitude of stream 27 by employing well known heat balance techniques.

Figure 3:
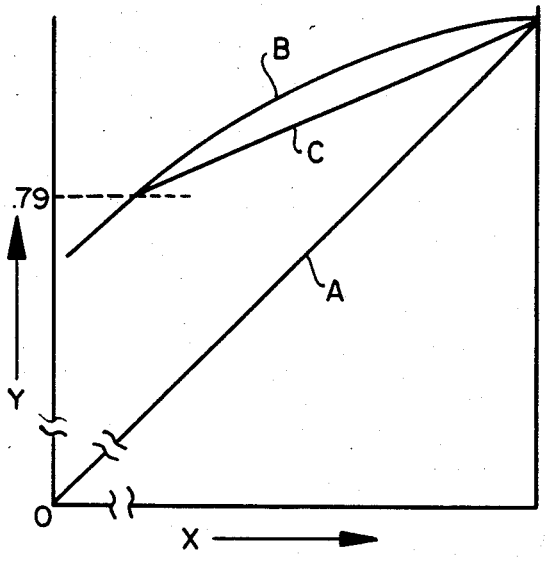
FIG. 3 (PRIOR ART)
FIG. 3 is a representative McCabe-Thiele diagram for a conventional single column air separation process.
Figure 4:
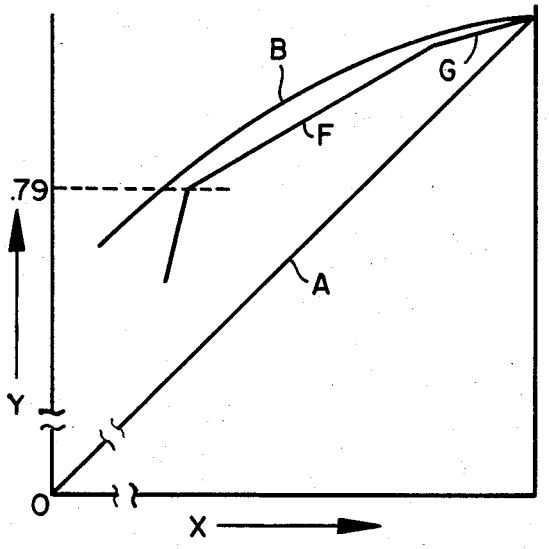
FIG. 4 is a representative McCabe-Thiele diagram for the process of this invention.

The manner in which the process of this invention can achieve the increased recovery of nitrogen can be demonstrated with reference to FIGS. 3 and 4 which are McCabe-Thiele diagrams respectively for a conventional single column air separation process and for the process of this invention. McCabe-Thiele diagrams are well known to those skilled in the art and a further discussion of McCabe-Thiele diagrams may be found, for example, in *Unit Operations of Chemical Engineering*, McCabe and Smith, McGraw-Hill Book Company, New York, 1956, Chapter 12, pages 689–708.

In FIGS. 3 and 4, the abscissa represents the mole fraction of nitrogen in the liquid phase and the ordinate represents the mole fraction of nitrogen in the vapor phase. Curve A is the locus of points where x equals y. Curve B is the equilibrium line for oxygen and nitrogen at a given pressure. As is known to those skilled in the art, the minimum capital cost, i.e. the smallest number of theoretical stages to achieve a given separation, is represented by an operating line, which is the ratio of liquid to vapor at each point in the columm, coincident with curve A; that is, by having total reflux. Of course, no product is produced at total reflux. Minimum possible operating costs are limited by the line including the final product purity on Curve A and the intersection of the feed condition and equilibrium line. The operating line for minimum reflux for a conventional column is given by Curve C of FIG. 3. Operation at minimum reflux would produce the greatest amount of product, that is, highest recovery, but would require an infinite number of theoretical stages. Real systems are operated between the extremes described above.

The capability for high nitrogen recovery of the process of this invention is shown in FIG. 4. Referring now to FIG. 4, the rectifying operating line is made up of at least 2 distinct segments. Segment F represents the main column between the air feed and the nitrogen reflux feed, and segment G describes the L/V ratio in the main column above this reflux point. Since the prefractionation provides a reflux having a high concentration of nitrogen, the slope of segment G can be very small. Consequently, a large amount of high purity product can be withdrawn from the top of the column as compared with the more limited amount available from the prior art arrangement. If the small heat balance air stream 27 is employed with the embodiment of FIG. 2, the third liquid feed would cause an additional angle in the rectifying operating line of FIG. 4, i.e. divide Segment F into 2 segments. The resulting third line segment would allow the operating line to even more closely approximate the shape of the equilibrium line.

Of course, recovery is not the only criterion that is used to compare the merits of two air separation plants. The capital cost of equipment and the efficiency of power consumption must be considered. However, for a given capital cost and power consumption, the cost per unit of product decreases with increased recovery.

As previously indicated, the flowrate of the minor air feed is from 5 to 40 percent, preferably from 10 to 30 percent of the total air feed. The minor air feed flowrate must at least equal the minimum flowrate recited in order to realize the benefit of enriched oxygen waste and, therefore, increased recovery. A minor air feed flowrate exceeding the maximum recited increases compression costs and causes excessive reboiling without significant additional enhancement of separation. Where refrigeration is produced by expansion of the major air stream, a higher level pressure is required to achieve the same refrigeration generation. Where the minor air stream undergoes booster compression, power costs increase with flowrate. The ranges recited for the minor air stream take advantage of the benefits of this cycle without incurring offsetting disadvantages in efficiency.

Table I gives a calculated example of the invention as practiced in accord with the embodiment of FIG. 1. The prefractionation zone in this case is a small column consisting of four trays as compared with a 40 tray main column. The values given for oxygen concentration include argon. As can be seen from Table I, the invention is able to produce high purity nitrogen while recovering 70% of the nitrogen in the feed air. The stream numbers correspond to those of FIG. 1 and the abbreviation mcfh means thousands of cubic feet per hour at standard conditions.

TABLE 1

| Stream No. | Flow (mcfh) | $O_2$ (mole percent) | $N_2$ (mole percent) | Temp. (°K.) | Pressure (psia) |
|---|---|---|---|---|---|
| 2 | 180 | 21 | 79 | 311 | 112 |
| 6 | 126 | 21 | 79 | 118 | 110 |
| 7 | 54 | 21 | 79 | 110 | 109 |
| 56 | 10 | 2 | 98 | 95 | 77 |
| 16 | 80 | 49 | 51 | 94 | 49 |
| 21 | 4 | .04 | 99.96 | 89 | 45 |
| 22 | 96 | .04 | 99.96 | 89 | 46 |
| 23 | 80 | 49 | 51 | 87 | 17 |
| 52 | 44 | 25 | 75 | 96 | 78 |

By the use of the process of this invention which includes the defined introduction of feed air, and reflux having a higher nitrogen concentration than air, into a main rectification column, one is able to produce relatively high purity nitrogen at high recovery, without starving the fractionation column of required reflux.

Although the process of this invention has been described in detail with reference to certain preferred embodiments, it can be appreciated that there are other embodiments of this invention which are within the spirit and scope of the claims.

I claim:

1. A process for the production of nitrogen at relatively high yield and purity by cryogenic rectification of feed air comprising avoiding the need to employ a full scale double column by the steps of:

(a) introducing the major portion of the feed air into a main rectification column which is operating at a pressure in the range of from 35 to 145 psia, and wherein feed is separated into nitrogen-rich vapor and oxygen-enriched liquid;

(b) introducing a minor portion of the feed air into a prefractionation zone at a pressure greater than that at which the main column is operating, and wherein the minor portion is separated into a nitrogen-enriched vapor fraction and an oxygen-enriched liquid fraction;

(c) condensing at least some of the nitrogen-enriched vapor fraction by indirect heat exchange with the oxygen-enriched liquid produced in the main column;

(d) introducing at least some of the resulting condensed nitrogen-enriched fraction, as reflux liquid and additional feed, into the main column at a point at least one tray above the point where the major portion of the feed air is introduced into the main column;

(e) condensing a first portion of the nitrogen-rich vapor by indirect heat exchange with vaporizing oxygen-enriched liquid;

(f) passing at least some o the resulting condensed nitrogen-rich first portion to the main column at a point at least one tray above the point where the condensed nitrogen-enriched fraction is introduced into the main column; and (g) recovering a second portion of the nitrogen-rich vapor as product nitrogen.

2. The process of claim 1 wherein said major portion comprises from about 60 to 95 percent of the feed air and said minor protion comprises from about 5 to 40 percent of the feed air.

3. The process of claim 1 wherein said major portion comprises from about 70 to 90 percent of the feed air and said minor portion comprises from about 10 to 30 percent of the feed air.

4. The process of claim 1 wherein the prefractionation zone operates at a pressure in the range of from 10 to 90 psi above the pressure at which the main rectification column is operating.

5. The process of claim 1 wherein all of the condensed nitrogen-rich first portion is passed to the main column.

6. The process of claim 1 wherein some of the condensed nitrogen-rich first portion is recovered as product liquid nitrogen.

7. The process of claim 1 wherein the entire feed air is compressed to a pressure greater than the operating pressure of the main column and the major portion of the feed air is expanded to the operating pressure of the main column prior to its introduction into the main column.

8. The process of claim 7 wherein the expansion of the feed air major portion generates refrigeration for the process.

9. The process of claim 1 wherein only the minor portion of the feed air is compressed to a pressure greater than the operating pressure of the main column.

10. The process of claim 1 wherein a third portion of the feed air is condensed by indirect heat exchange with at least one return stream and the resulting condensed third portion is introduced into the column at a point between the points where the major portion of the feed air and the condensed nitrogen-enriched fraction are introduced into the main column.

11. The process of claim 1 wherein the product nitrogen has a purity of at least 98 mole percent.

12. The process of claim 1 wherein the product nitrogen is at least 50 percent of the nitrogen fed to the process.

13. The process of claim 1 wherein at least some of the oxygen-enriched liquid fraction is introduced into the main rectification column, at a point at least one tray below the point where the condensed nitrogen-enriched fraction is introduced.

14. The process of claim 1 wherein the prefractionation zone comprises a small column having no more than one half the number of equilibrium stages as has the main column.

15. The process of claim 1 wherein the prefractionation zone comprises at least one condenser and phase separator.

* * * * *